United States Patent [19]

Gonzalez

[11] 3,939,812

[45] Feb. 24, 1976

[54] VACUUM ADVANCE REGULATING VALVE

[75] Inventor: Jose Leobardo Gonzalez, Mexico City, Mexico

[73] Assignee: Monocar HC Internacional, S.A.

[22] Filed: July 29, 1974

[21] Appl. No.: 492,809

[30] Foreign Application Priority Data

Aug. 9, 1973 Mexico ..... 145477

[52] U.S. Cl. ..... 123/117 A

[51] Int. Cl.[2] ..... F02P 5/04

[58] Field of Search ..... 123/117 A

[56] References Cited

UNITED STATES PATENTS

| | | | |
|---|---|---|---|
| 3,688,753 | 9/1972 | Walker | 123/117 A |
| 3,779,220 | 12/1973 | Wu | 123/117 A |

*Primary Examiner*—Wendell E. Burns
*Assistant Examiner*—James Winthrop Cranson, Jr.
*Attorney, Agent, or Firm*—Ladas, Parry, Von Gehr, Goldsmith & Deschamps

[57] ABSTRACT

A valve to prevent atmospheric contamination which automatically regulates the vacuum advance of the distributor in internal combustion engines, which comprises a conduit having two terminals, one of which is communicated to the vacuum connection of said carburetor, and the other one is connected to the vacuum advance mechanism of the distributor, having said conduit a venting orifice, and the referred conduit can be obstructed by a valve closing element connected to a diaphragm confined between two main bodies, one of which comprises said conduit and the other one is composed of a tubular body with inside threading which houses a spring which presses with one of its ends against the diaphragm and with the other end biasing against the lower portion of a threaded nipple, which screws into said inside threaded of said tubular body; said threaded nipple comprising a lengthwise bore which extends through a tube which by means of a hose is connected to the intake manifold of the carburetor, permitting the opening of the valve when the engine is working with load.

6 Claims, 2 Drawing Figures

VACUUM ADVANCE REGULATING VALVE

BACKGROUND OF THE INVENTION

This invention refers to devices for preventing atmospheric contamination in general, and particularly relates to a valve for preventing atmospheric contamination which regulates automatically the vacuum advance of distributors in internal combustion engines equipped with carburetors.

One of the fundamental current problems of the human race related to the population explosion and to unrestricted industrialization is that of the contamination of the atmosphere, that is, the gradual destruction of our life environment.

It has been demonstrated that contamination of the atmosphere is due primarily to contamination caused by the gases generated by vehicles and particularly those produced by gasoline-powered internal combustion engines thereof.

One of the most harmful of the contaminating gases is carbon monoxide, which is particularly the result of imperfect combustion in the said engines.

Up to the present, massive efforts have been made in science and technology toward the objective of reducing this carbon monoxide, by regulating the air-fuel mixture at the proper moment, in order to obtain a more perfect combustion and free from residues, whereby production of the aforementioned carbon monoxide is notably reduced.

Notwithstanding the foregoing, it has been shown that as combustion becomes more perfect, reducing the carbon monoxide content, production of other gases which are also environmental contaminants increases: the oxides of nitrogen. These nitrogen oxides, among other harmful effects, causes problems for the eyesight such as irritation and burning of the eyes, besides smudging the atmosphere; accordingly it has been determined to regulate the production of these oxides at a certain level below which they cause no harm. Nevertheless, up to the present time the harmful level has been exceeded mainly through the use of anitcontamination devices to improve combustion; that is, a difficult problem to solve is facing technology, since on the one hand carbon monoxide has been reduced by more perfect combustion, on the other hand it increases the production of nitrogen oxides which are also contaminants.

Combustion occurs upon causing the ignition of the air-fuel mixture in the combustion chamber within a cylinder of an internal combustion engine. Perfect regulation of the mixture results in better combustion; however, if the ignition, which is accomplished by sending a high-voltage impulse from the distributor to the corresponding spark plug, takes place at a certain time, a very high temperature is produced, above 2,192°F, which is what propiciate that the above mentioned oxides of nitrogen be originated.

At present regulation of the spark in the distributor is produced in two ways: one by means of centrifugally regulated mechanism, attached directly to the shaft of the distributor, aand the other by systems called vacuum advance which works by connection with a vacuum line from the carburetor, through a spring and a diaphragm to the distributor plate which retards or advances the instant in which the high voltage impulse is delivered to the spark plug which in turn will produce the spark for ignition.

SUMMARY OF THE INVENTION

If the conventional system of regulating ignition called vacuum advance is equipped with a device that consists in a valve which prevents the passage of air from the distributor to the carburetor at a given instant, the timing is retarded or advanced for passing the spark within the combustion chamber and accordingly ignition will be accomplished when the piston has not reached that point in its stroke where firing normally occurs, or it will have passed beyond it, whereby the temperature of combustion will be reduced and the oxides of nitrogen will not be generated above the level where they are harmful, and the efficiency of the internal combustion engine will not be substantially affected.

In view of the foregoing, it is an object of this invention to provide a simple valve device which alters, by advancing or retarding, the vacuum advance of the distributor at a given moment, preventing the production of oxides of nitrogen without detriment in handling of the vehicle.

This device has the great advantage that it can be installed in engines in production or already in use, with no need to redesign their internal parts.

The valve of the present invention consists in practice of two principal parts which are joined together, confining within a chamber formed between them a diaphragm which actuates a sealing means in the shape of a needle. One of the two principal parts is hollow and cylindrical and within it the cited sealing means is housed. This body has two outlets which form a conduit which is intercepted by the sealing means, and said outlets are connected by means of suitable hoses to the distributor and to the vacuum connection of the carburetor which regulates respectively the vacuum advance of the distributor.

The second principal body houses a spring the tension of which can be varied by means of a threaded nipple with locknut to secure it in position. This said locknut includes an annular elastomer sealing means to prevent any leakage. The said threaded nipple includes a longitudinal perforation which opens into a passage which in turn in connected by means of an appropriate hose to a vacuum line in the intake manifold.

During the period of acceleration or at full load, the vacuum in the intake manifold drops off, and this causes the spring to actuate the diaphragm of the valve and in turn the sealing means, blocking the passage of air to the carburetor from the distributor, and consequently the vacuum advance in the distributor does not occur under these conditions.

When the motor is under no load, the valve is actuated by the suction applied to it from the intake manifold and remains open, and under these conditions the original system of vacuum advance of the distributor operates normally, causing the engine accordingly to operate normally.

These and other objects to be obtained through the use of this invention will be more clearly understood and more fully appreciated through the following description which refers to the accompanying drawings of the preferred embodiment of the invention.

DETAILED DESCRIPTION OF THE INVENTION

Figure 1:
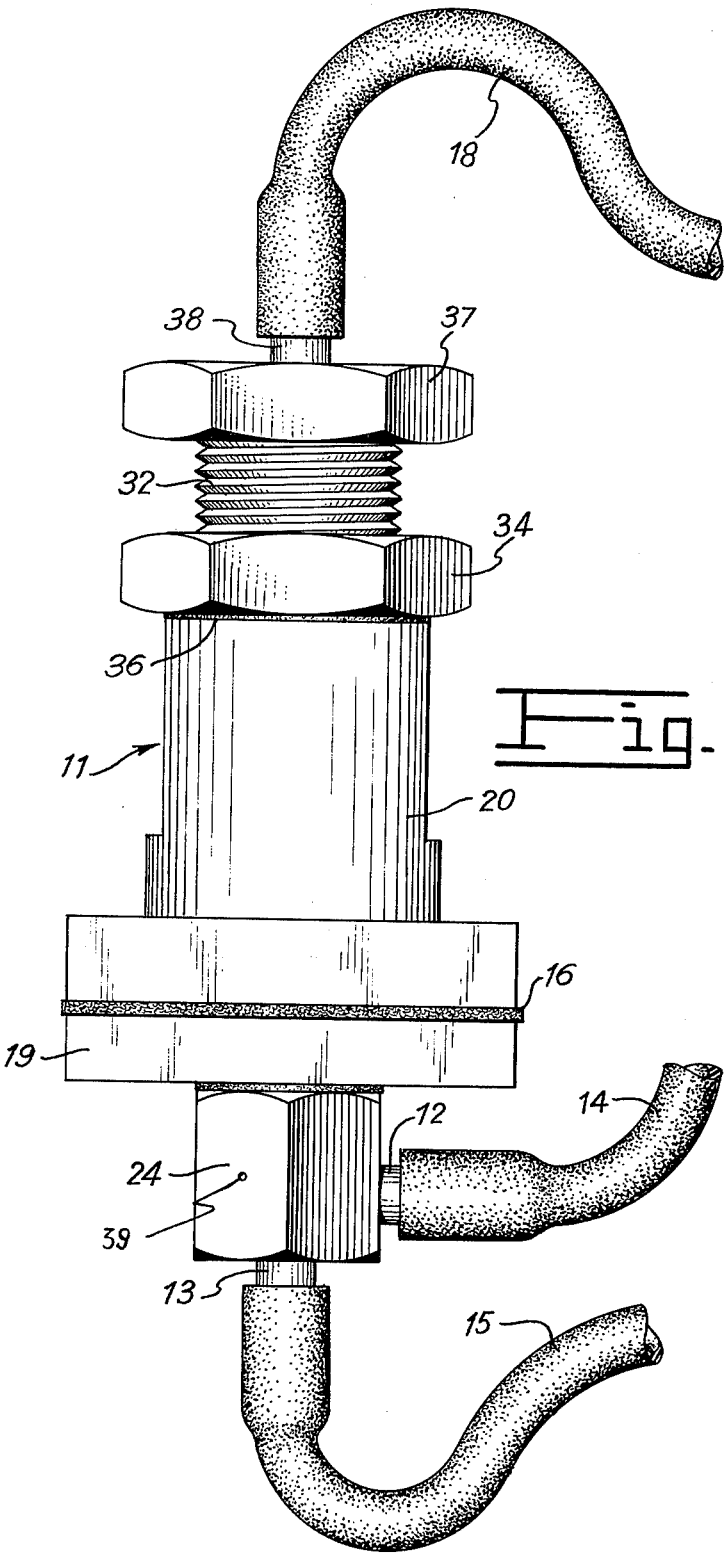
FIG. 1 is a view in vertical elevation of the valve of the present invention, and also shows diagrammatically and on a reduced scale the carburetor, the distributor and the intake manifold of an engine equipped with the valve.
Figure 2:
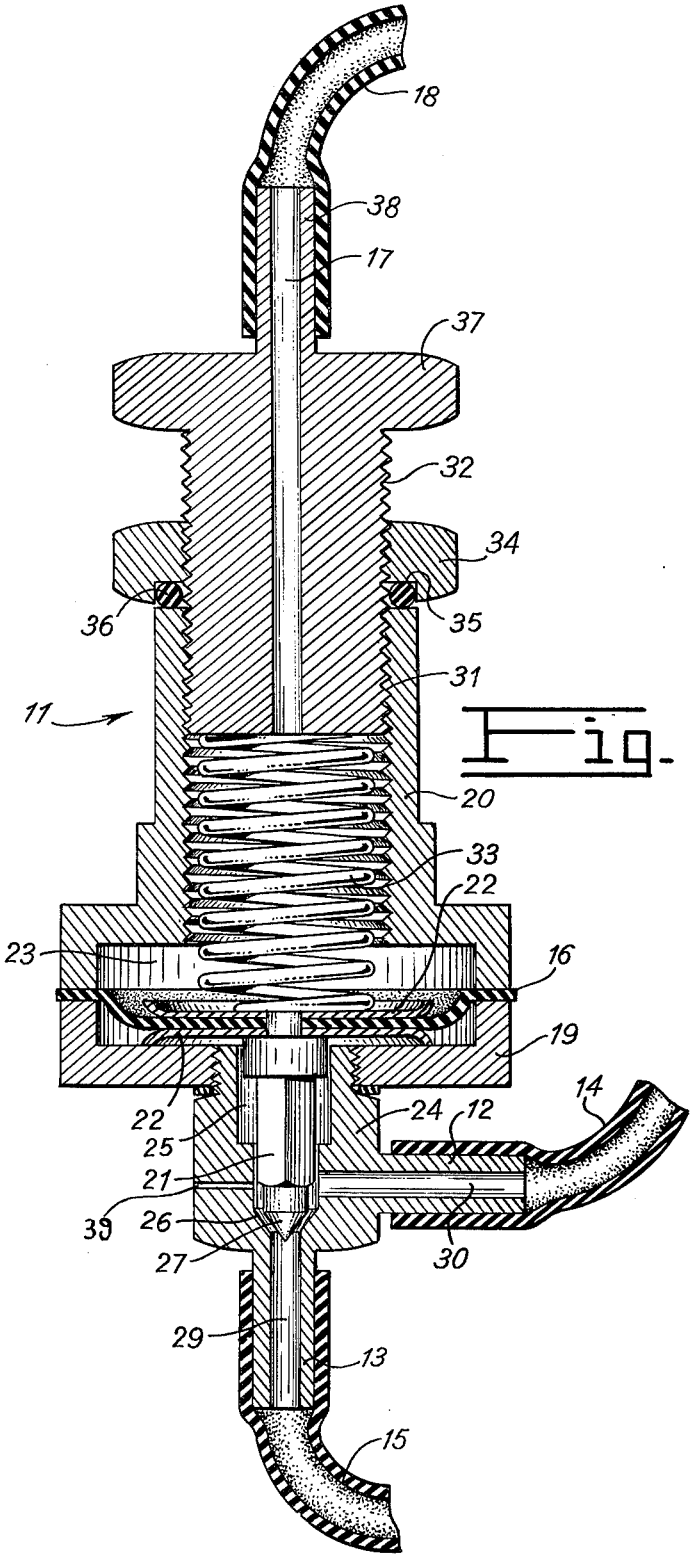
FIG. 2 is a view in longitudinal cross-section of the valve illustrated in FIG. 1, showing its internal construction.

The valve which regulates the vacuum advance of the distributors of internal combustion engines in the present invention has for its object to control the time at which the spark is passed in the combustion chamber, at a different time from the conventional one of ignition and thereby to reduce the temperature of combustion below 2192°F., whereby the production of contaminating oxides of nitrogen is reduced to below the harmful level; to achieve the foregoing this valve delay the vacuum advance during the initial period of suction from the carburetor to the distributor in its vacuum line which controls the vacuum advance of the distributor; this delay is desirable to control in a more efficient manner the vacuum advance operation, and for that purpose, valve 11 of the present invention includes sealing device for opening or closing an air suction line with terminals 12 and 13 which are connected by means of hoses 14 and 15; respectively, hose 15 communicates to the vacuum connection of the carburetor which is used to obtain the vacuum advance of the distributor, and hose 14 to the distributor, specifically in the mechanism which controls the vacuum advance thereof; the sealing mechanism of the valve is actuated by the suction which is applied upon diaphragm 16, by way of orifice 17, to which is connected a suitable hose 18, which in turn is attached to the intake mainfold, whereby during the period of acceleration or full load the vacuum of the intake manifold decreases and in this instant the valve of the present invention deactivates because there is not sufficient suction to operate it, and automatically the air suction is interrupted in passages 12 and 13 of the valve, thus preventing suction along the tube which actuates the vacuum advance of the distributor, thus causing the ignition spark to be advanced or retarded in order to keep the combustion temperature below 2192°F.

When the engine is not accelerated, suction from the intake manifold acts upon the valve of this invention, actuating diaphragm 16, which opens its passages 12 and 13 and permits normal suction from the carburetor to the distributor, thus maintaining at normal operation the vacuum advance of the distributor.

Valve 11 of the present invention is composed of the two bodies 19 and 20 which are joined together, seizing between them a valve closure means consisting of diaphragm 16, which is integral with a sealing element 21 of needle type; two discs or plates 22 reinforce the junction between the sealing element and the diaphragm, one on each side of diaphragm 16, which moves in a chamber 23, formed by the juxtaposition of the two bodies 19 and 20 above mentioned. Body 19 has a tubular portion 24, with an internal cylindrical bore 25 which ends in a tapering portion 26 which serves as the seat for the sealing element 21, which likewise has a conical end portion 27 and has in a general way the shape of a needle. In portion 24 of body 19 there are two bores; one axial bore 29, which is the continuation of bore 25 above mentioned, within which sealing element 21 moves, and which continues through tubular passage 13 to which hose 15 is fitted, and joins the vacuum line of the carburetor, which controls the vacuum advance of the distributor; also, in portion 24 of body 19 is the second bore 30, transverse in relation to the first bore which opens into bore 25 in which selaing element 21 moves; transverse bore 30 extends into tubular channel 12, to which hose 14 is attached, which in turn is connected to the distributor specifically in the vacuum advance mechanism. Body 20 extends as a tube from that portion of itself which seizes diaphragm 16, and includes an internal thread 31, into which is screwed threaded nipple 32. Said threaded nipple 32 when screwed into princiapl body 20 biases spring 33 which is contained within said tubular body 20, against one of the plates 22 which are integral with diaphragm 16, whereby the tension of said spring is adjusted for a certain suction of the intaake manifold of the internal combustion engine, to which the valve of the present invention is attached. The position of the threaded nipple 32 in relation to principal body 20 is secured by means of locknut 34 threadedly secured to said nipple 32, and said locknut has a counterbore 35 in its portion contacting the edge of the end of principal body 20, to hold therein an elastomer sealing ring 36, to prevent any leakage.

Passage 17 above mentioned, through which the suction from the intake manifold acts to operate the valve of the present invention, is located as the lengthwise axial bore of threaded nipple 32. Said nipple 32 may have at its outer end an hexagonal enlargement like a bolt head 37, to facilitate the adjustments of the tension of spring 33 of the valve. Bore 17 extends through tube 38, to which the said hose 38 is attached, which leads to the vacuum connection of the intake manifold of the carburetor of the engine to which said valve is attached, a venting orifice 39 is included for the equilibrium of pressures, said orifice, is located in the tubular portion 24, that permits a correct functioning of valve 11.

From the foregoing, it is evident that the conventional vacuum line which goes from the carburetor to the distributor of an internal combustion engine, to control the vacuum advance of the distributor which will determine the precise timing of the ignition, passes through hose 14, channel 12 with its orifice 30, bore 25 of the valve, passage 29 of tube 13 and hose 15; and that to permit the travel of the suction which actuates the vacuum advance of the distributor, the required condition is that the sealing element of valve 21 has been actuated by suction acting on diaphrgm 16, to allow a clear air passage. This vacuum advance condition is only realized at the times when there is no load or acceleration on the internal combustion engine, which is when suction is produced in the intake manifold of the carburetor sufficient to overcome the tension of spring 23, through hose 18, connected to the said intake manifold and through lengthwise bore 17 of threaded nipple 32. This means that at the time of maximum acceleration the vacuum within the intake manifold decreases, and therefore the tension of spring 23 is sufficient to press diaphragm 16 down, through one of the plates 22, and compelling the sealing element 21 to close the passage between bores 29 and 30 of the valve, thus preventing the transmission of the required suction from the carburetor suction connection to the vacuum advance whereby the timing of the ignition is modified and hence the temperature is reduced to less than 2,192°F., avoiding the formation of the undesirable and contaminating oxides of nitrogen.

While the preceding description has been made in relation to one specific embodiment of the invention it will be understood by all experts in the field that any modification in form or detail is incuded within the spirit and scope of this invention.

I claim:

1. A valve to prevent atmospheric contamination which automatically regulates the vacuum advance of the distributor in internal combustion engines, in which is included a passage which communicates a vacuum connection of the carburetor with a vacuum advance mechanism of the distributor, characterized in that it includes a conduit having two terminals, one of which is connected to the vacuum connection of said carburetor, and the other one is connected to the vacuum advance mechanism of the distributor, and in that the referred conduit can be obstructed by a valve closing element connected to a diaphragm confined between two principal bodies, one of which comprises said conduit and the other one is composed of a tubular body with inside threading which houses a spring that presses with one of its ends against the diaphragm and with the other end beasing against the lower portion of a threaded nipple, which screws into said inside threaded portion of said tubular body; said threaded nipple comprising a lengthwise bore which extends through a tube which by means of a hose is connected to the intake manifold of the carburetor, permitting the opening of the valve when the engine is working without load.

2. A valve to prevent atmospheric contamination which automatically regulates the vacuum advance of the distributor in internal combustion engines, as set forth in claim 1, further characterized in that it has a locknut to secure the threaded nipple in a position with relation to the threaded tubular body giving a certain tension to the spring.

3. The valve to prevent atmospheric contamination which automatically regulates the advance of the distributor in internal combustion engines, as set forth in claim 1, further characterized in that the locknut includes a counterbore in which is placed a sealing element between the upper edge of the threaded tubular body and the locknut.

4. The valve to prevent atmospheric contamination which regulates automatically the advance of distributors in internal cobustion engines, as set forth in claim 1, characterized furthermore in that the sealing member of the valve ends in a conical point which rests in a trucated cone seat having a venting orifice in the body of the valve, which includes the conduit which is connected to the vacuum connection of the carburetor and to the vacuum advance mechanism of the distributor.

5. The valve to prevent atmospheric contamination which regulates automatically the advance of the distributor in internal combustion engines, as set forth in claim 1, further characterized in that diaphragm which is integral with the sealing member of the valve includes two plates for reinforcement, one on each side thereof.

6. The valve to prevent atmospheric contamination which regulates automatically the advance of the distributor in internal combustion engines, as set forth in claim 1, further characterized in that the threaded nipple ends in an enlargement shaped like a bolt head to adjust the tension of the spring.

* * * * *